US007481549B2

(12) United States Patent
Hess

(10) Patent No.: US 7,481,549 B2
(45) Date of Patent: Jan. 27, 2009

(54) LUMINOUS GLASS WALL

(76) Inventor: Jürgen Hess, Tilsiterstr. 27, 78052 Villingen (DE)

( * ) Notice: Subject to any disclaimer, the term of this patent is extended or adjusted under 35 U.S.C. 154(b) by 0 days.

(21) Appl. No.: 11/961,450

(22) Filed: Dec. 20, 2007

(65) Prior Publication Data

US 2008/0151536 A1 Jun. 26, 2008

(30) Foreign Application Priority Data

Dec. 22, 2006 (DE) ..... 20 2006 019 418 U

(51) Int. Cl.
*F21S 8/00* (2006.01)

(52) U.S. Cl. ..... 362/147; 362/125; 362/240; 362/800; 52/306; 52/307

(58) Field of Classification Search ..... 362/125, 362/126, 145, 147, 240, 800; 52/306, 307
See application file for complete search history.

(56) References Cited

U.S. PATENT DOCUMENTS 2,216,220 A * 10/1940 Baker ..... 362/147
4,223,377 A * 9/1980 Williams ..... 362/145
6,764,196 B2 * 7/2004 Bailey ..... 362/147

* cited by examiner

*Primary Examiner*—Stephen F Husar
(74) *Attorney, Agent, or Firm*—McGlew & Tuttle, P.C.

(57) ABSTRACT

A glass wall (1) has two parallel wall elements (3), at least one of which consists of a material made of glass or a similar material, which is transparent to light, and behind which LEDs, with which the transparent wall element (3) can be lit translucently, are arranged in rows as illuminating devices. To achieve illumination of the glass wall (1) over the largest possible areas, provisions are made for LED light sources (7) to be arranged in a small number of illuminating groups on plate-like carriers (17) in the area of the front-side end of a narrow, elongated light chamber (6). A plurality of such light chambers are arranged separated by transverse walls (4, 4', 5) in the vertical position next to each other or in the horizontal position one on top of another to form the glass wall (1). Each light chamber (6) has at least one translucent wall element (3) with an inner surface having a refractive and reflecting structure. The LED light sources (7) are equipped with focusing lenses (10) converging optically to divergence angles ($\alpha$) of up to 20° and are arranged such that their light, emitted in the longitudinal direction of the respective light chamber (6), is partly reflected multiply on the inner surfaces of the wall elements (3) and is partly visible from the outside through at least one transparent wall element (3) over the length of the wall element.

21 Claims, 5 Drawing Sheets

2
3
4
5
h
1 t
b
γ

LUMINOUS GLASS WALL

CROSS REFERENCE TO RELATED APPLICATIONS

This application claims the benefit of priority under 35 U.S.C. § 119 of German Patent Application DE 20 2006 019 418.5 filed Dec. 22, 2006, the entire contents of which are incorporated herein by reference.

FIELD OF THE INVENTION

The present invention pertains to a glass wall with two parallel wall elements, at least one of which includes a transparent material made of glass or a similar material, behind which LEDS, with which the transparent wall element can be lit in a translucent manner, are arranged in rows as illuminating means.

BACKGROUND OF THE INVENTION

Glass walls as architectonic structural elements for buildings have been known for a long time. There are single-shell, double-shell and multi-shell glass walls, which are installed both as outside walls of buildings and as partitions within buildings. Even though such glass walls have always had the special task of letting daylight into the building and/or artificial light out of the building because of their transparency, they have also been manufactured for quite some time, especially since the development of high-performance LEDs, as facades lighting in the darkness ("LED Light from the Light-emitting Diode," issue No. 17 of the Fördergemeinschaft Gutes Licht, Postfach 701261, 60591 Frankfurt, p. 15). More than 80,000 LEDs, which can be caused to light in all imaginable colors by means of a light management system according to the RGB pattern, are arranged in a known double-shell translucent glass facade in chains. The two wall shells of this glass facade consist of composite, non-transparent translucent glass panes of several m in height and about 1 m to 1.5 m in width. These glass panes are fastened to a vertical frame construction, which is arranged between the two wall shells and carries same. The LED chains are arranged each along the vertical lateral edges of the individual translucent glass panes, which are flush with one another, in the frame construction.

Rolled, rail-like building glass sections of various sizes, which are provided with a flat wall element with edge strips, so-called flanges, which project at the longitudinal edges in one direction at right angles to the plane of the wall element, are also available for preparing self-supporting transparent (translucent) glass walls. These building glass sections are offered with various surface structures, so-called ornaments, which generate a special refraction of light and produce different optical impressions as a result or can be used for various technical applications, e.g., for solar systems. These building glass sections are available in a plurality of different sizes, and they can be used to prepare single-shell and double-shell glass walls in the horizontal position as well as in the vertical position.

However, such glass walls have not hitherto been equipped with illuminating means that cause such glass walls to light up.

SUMMARY OF THE INVENTION

The basic object of the present invention is to provide a double-shell glass wall with integrated illumination, which has a simple design and in which the light generated by the LEDs arranged between the two wall elements forming the glass wall becomes visible from the outside distributed as uniformly as possible over the surfaces to be illuminated.

This object is accomplished according to the present invention by the LEDs being arranged in a small number of illuminating groups on plate-like carriers in the area of the front-side end of a narrow, elongated light chamber, wherein a plurality of such light chambers, arranged separated by transverse walls in the vertical position next to each other or in the horizontal position one on top of another, form the glass wall, and each light chamber has at least one translucent wall element with an inner structure having a refractive and reflecting structure, and wherein the LEDs are equipped with lenses converging optically to divergence angles ($\alpha$) of up to 20° and are arranged such that their emitted light is partly reflected multiply on the inner surfaces of the wall elements and is partly visible from the outside through the at least one transparent wall element over the entire length of that element.

Large-surface glass walls can be prepared and illuminated from the inside with this design in a simple manner such that readily visible light intensity is present even at the wall areas located farthest away from the light sources. It is also advantageous that the light sources, i.e., the LEDs, are arranged locally in the hollow wall where they are also readily accessible and can be replaced. The division into light chambers is also advantageous because the partitions of these chambers can be used to guide the light appropriately in order to obtain improved distribution of light over the wall areas of the individual light chambers, these wall areas appearing as more or less narrow wall strips.

The use of the LEDs in a small number of illuminating groups of, for example, 6, 10 or 12 LEDs on plate-like carriers is also advantageous in such glass walls that can be illuminated especially in terms of installation, the possibility of replacement and the possibility of individual actuation.

The present invention will be explained in more detail below on the basis of the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENTS

Figures 1, 1A:
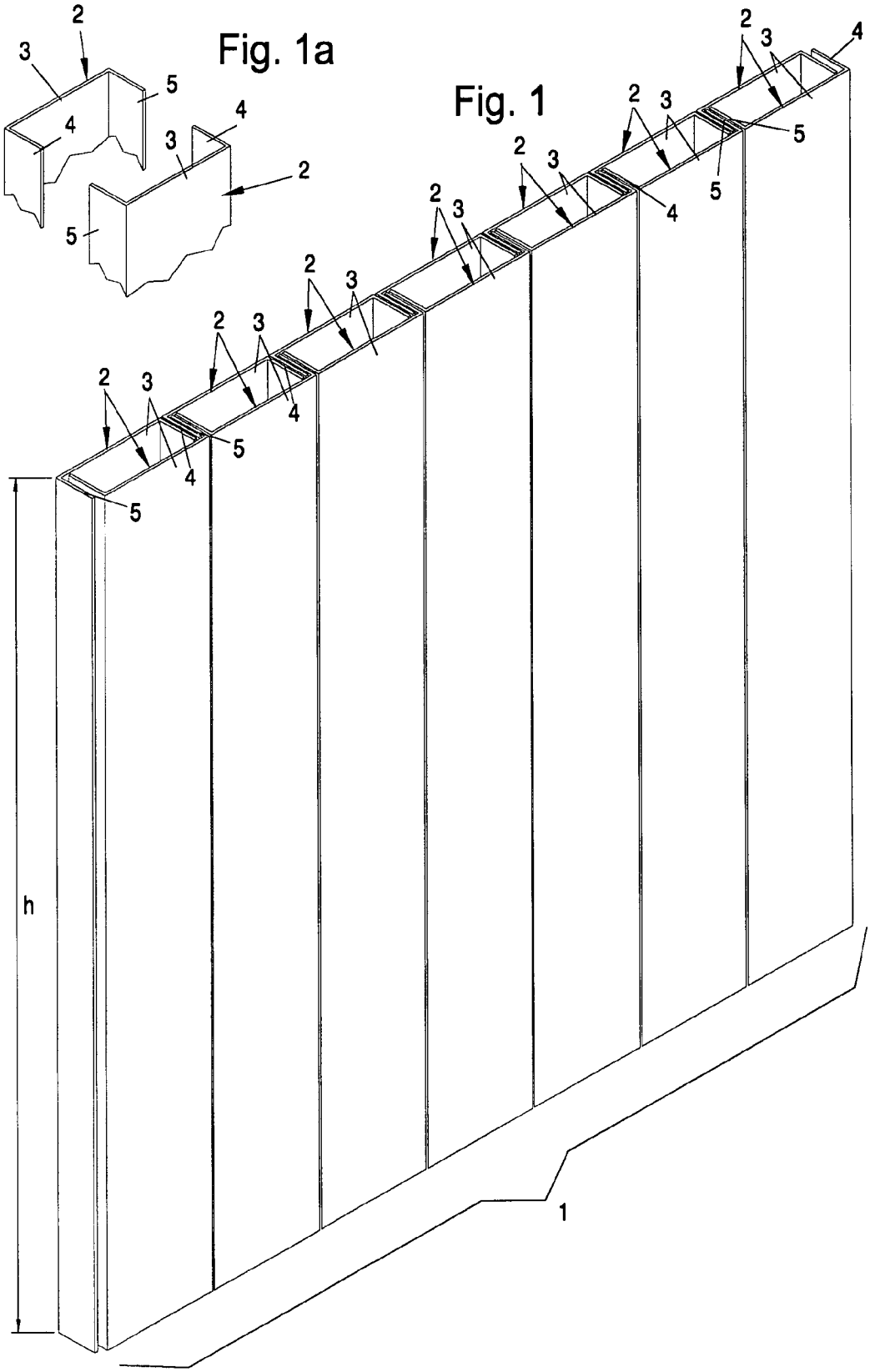
FIG. 1 is a schematic isometric view showing a design of a glass wall comprising sectional glass rails.
FIG. 1*a* is a schematic isometric partially broken away view showing upper sections of two sectional glass rails turned against each other with their edge strips.

Referring to the drawings in particular, FIGS. 1 through 4 show a double-shell glass wall 1 as an exemplary embodiment, which is prepared from a plurality of sectional glass rails 2 lined up laterally next to each other in the vertical position. These sectional glass rails 2, whose cross-sectional profile can be recognized from FIGS. 1, 1*a* and 4 as well as from FIG. 6, consist of rolled glass. They have a wall element 3 each, which forms the flat side and at the longitudinal edges of which edge strips 4 and 5 projecting toward one side at right angles to the plane of the wall element 3 are arranged.

These sectional glass rails 2 are arranged to form the glass wall 1 such that the wall elements 3 of two sectional rails each are located opposite each other in parallel positions and form a rectangular light chamber 6 each with their edge strips 4 and 5, which overlap in pairs. The wall element 3 of a sectional glass rail 2 preferably has a width b (FIG. 6) that is at least twice the depth t of an edge strip 4 or 5.

Such sectional glass rails 2 are available with various dimensions, and the overall width b may be between 23 mm and 500 mm and the edge strips may be provided with a depth of 41 mm to 60 mm.

As can be recognized from the drawings, two edge strips 4 and 5 each of two sectional glass rails 2 located opposite each other form the narrow-side limitation of a light chamber 6. The inner sides of these edge strips 4 and 5 located opposite each other in pairs may be metal-coated. As is apparent from FIGS. 7 through 11, it may be expedient and advantageous from the viewpoint of lighting technology to make the inner side of at least one of these edge strips 4 or 5 concave according to FIG. 7 or convex according to FIG. 8. Another possibility is to design the inner side of at least one of the edge strips 4 or 5 forming the light chamber 6 prismatic according to FIG. 9 or 10 or to allow them to extend obliquely at an obtuse or acute angle in relation to the wall element 3 according to FIG. 11.

The height h of a sectional glass rail may amount up to 8.5 m with the manufacturing and processing methods known so far.

Thus, there are many possibilities of design with such sectional glass rails 2 in terms of the structural design of such a double-shell glass wall 1.

Figure 2:
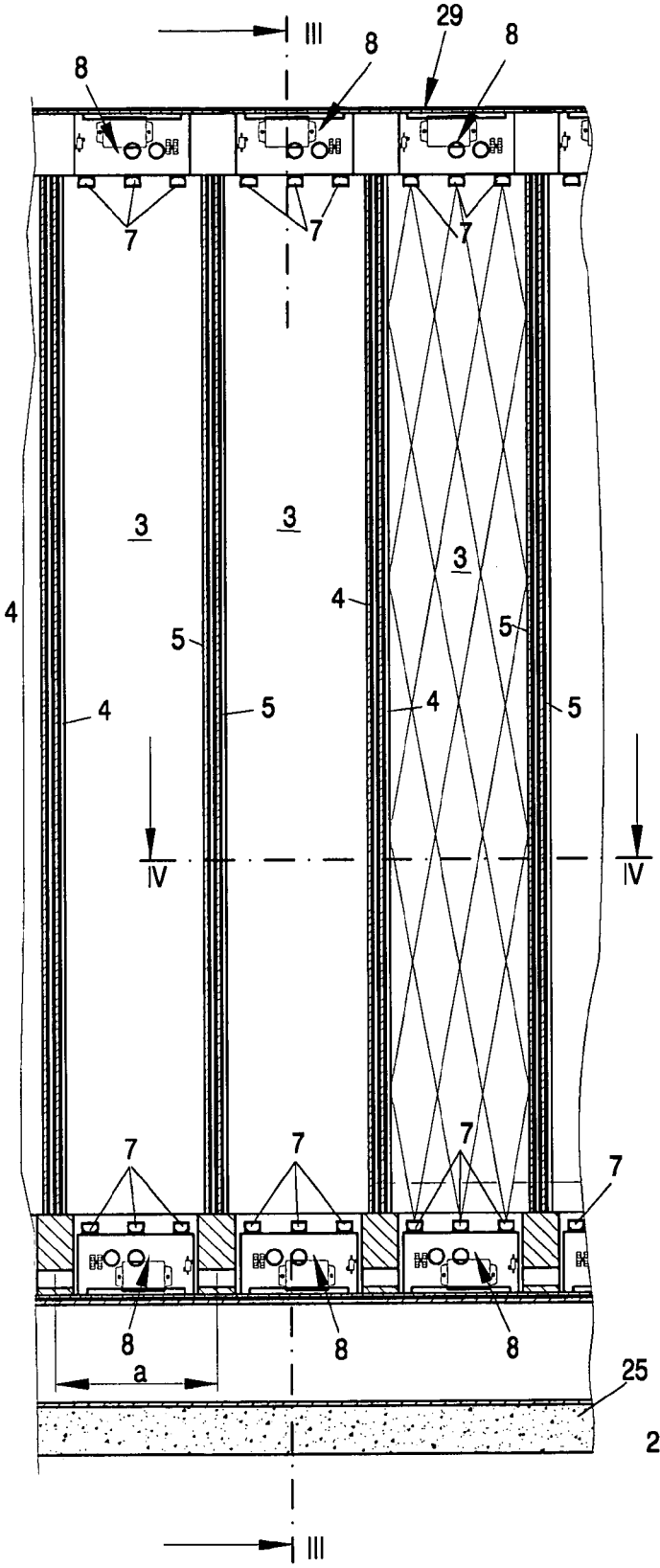
FIG. 2 is a detail sectional view along section line II-II from FIG. 3 of the glass wall from FIG. 1 with illuminating groups.
Figure 3:
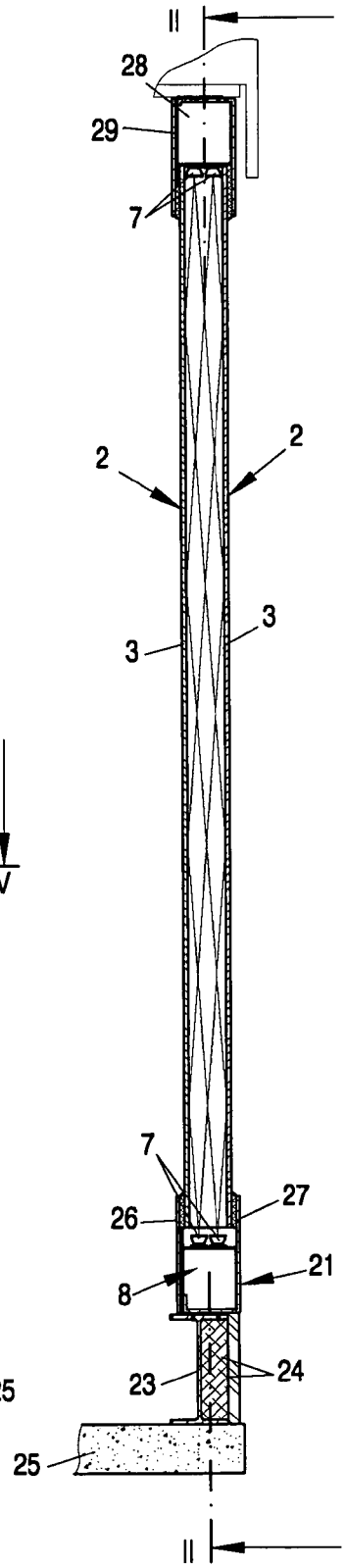
FIG. 3 is a sectional view along section line III-III from FIG. 2.

Illuminating units 8, which illuminate the glass wall within the individual light chambers 6 such that the glass wall elements 3 are perceptible from the outside of the light chambers as luminous surfaces, are located within the wall elements 3 or the light chambers 6 defined by same at the upper and lower ends in the exemplary embodiment according to FIGS. 2 and 3.

It may also be sufficient to arrange illuminating means at the upper or lower end of the glass wall only in the case of glass walls 1 prepared from shorter sectional glass rails.

The illuminating units 8 comprise LEDs, which are arranged centrally in mounting plates 9 and are provided with focusing lenses 10 each. Together with the mounting plates 9 and the focusing lenses 10, these LEDs form a LED light source 7.

To generate light of different colors, a plurality of LEDS generating different colors are arranged centrally in a mounting plate and are provided together with a focusing lens 10. These focusing lenses 10 are designed such that the cone angle of their light exit cone is reduced to a cone angle of up to 20 and preferably 10, which latter cone angle is symmetrical to the window axis 11 of the LED light source 7, so that each LED light source 7 sends the light generated by it into the light chamber 6 within this maximum cone angle of preferably 10. It is expedient to arrange the LED light sources 7 such that their optical axes 11 extend at least approximately in parallel to the wall surfaces of the light chambers 6.

Each focusing lens 10 is provided with a paraboloidal mirror 12, which brings about the described reduction of the light exit cone, which may be normally up to 120, to a cone angle of up to 20.

The individual LEDs, which are integrated in a LED light source 7 each, can be actuated separately to generate different colors of light.

Figure 17:
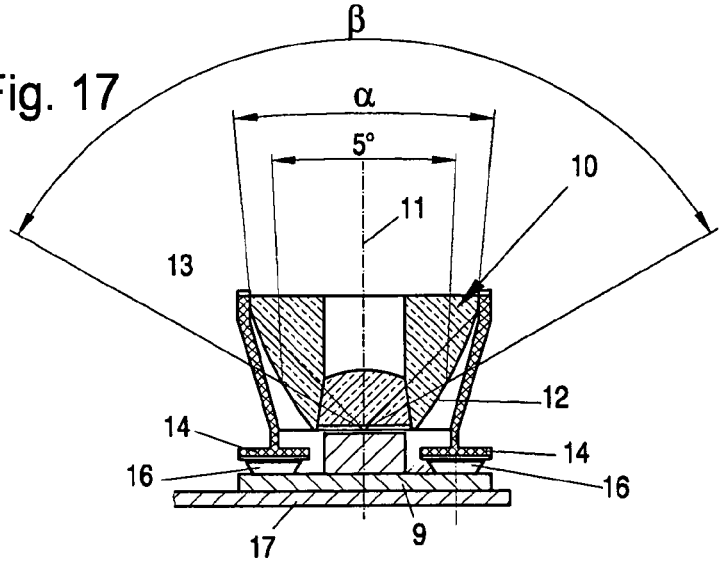
FIG. 17 is a sectional view of an illuminating unit.

As can be best recognized from FIG. 17, the focusing lens 10, which is known per se, is accommodated in a plastic housing 13, which is provided with foot strips 14, which are fastened to the mounting plate, for example, by bonding. The mounting plate 9 is attached to a horizontal plate-like carrier 17 by means of screws 16.

The LEDs or LED light sources 7 are thus arranged in a small number of groups on the plate-like carriers 17 in the area of the front-side end of a narrow, elongated light chamber 6. A plurality of light chambers 6 are separated from each other by transverse walls, which are formed by the edge strips 4 and 5. The wall elements 3 are provided with an inner surface having a refractive and reflecting structure in order to achieve the most uniform possible distribution of light over the entire area of the wall elements. Combined with the focusing lenses 10, which converge the light emitted by the LEDS to a divergence angle of up to 20 and preferably 10, it is achieved that the light emitted by the LED light sources 7 in the longitudinal direction of the respective light chambers 6 is partly reflected multiply on the inner surfaces of the wall elements 3 and partly becomes visible from the outside through the transparent wall element 3 over the entire length and width thereof.

To ensure this optimally, it is useful to provide the light chambers 6 with an essentially rectangular cross-sectional shape. The inner surfaces of the transparent wall elements 3, which have a refractive and reflecting structure, may be flat, but optionally also concavely or convexly arched. In any case, it is advantageous that at least one side, either the inner side or the outer side of the transparent wall elements 3, has a rough surface structure, and the inner and outer surfaces of the wall elements 3 may have different degrees of roughness.

As is apparent from FIGS. 2 and 3, support blocks 22, the distances a between the centers of which correspond to the widths b of the sectional glass rails 2, are arranged in a wall socket 21 to supportingly receive the sectional glass rails 2 in case of vertical arrangement of the light chambers 6. The illuminating units 8 with their illuminating groups, which comprise a relatively small number of, e.g., 6 to 8 or 12 LED light sources 7, are arranged with the corresponding control units 20 in the cavities between these support blocks 22.

Figure 14:
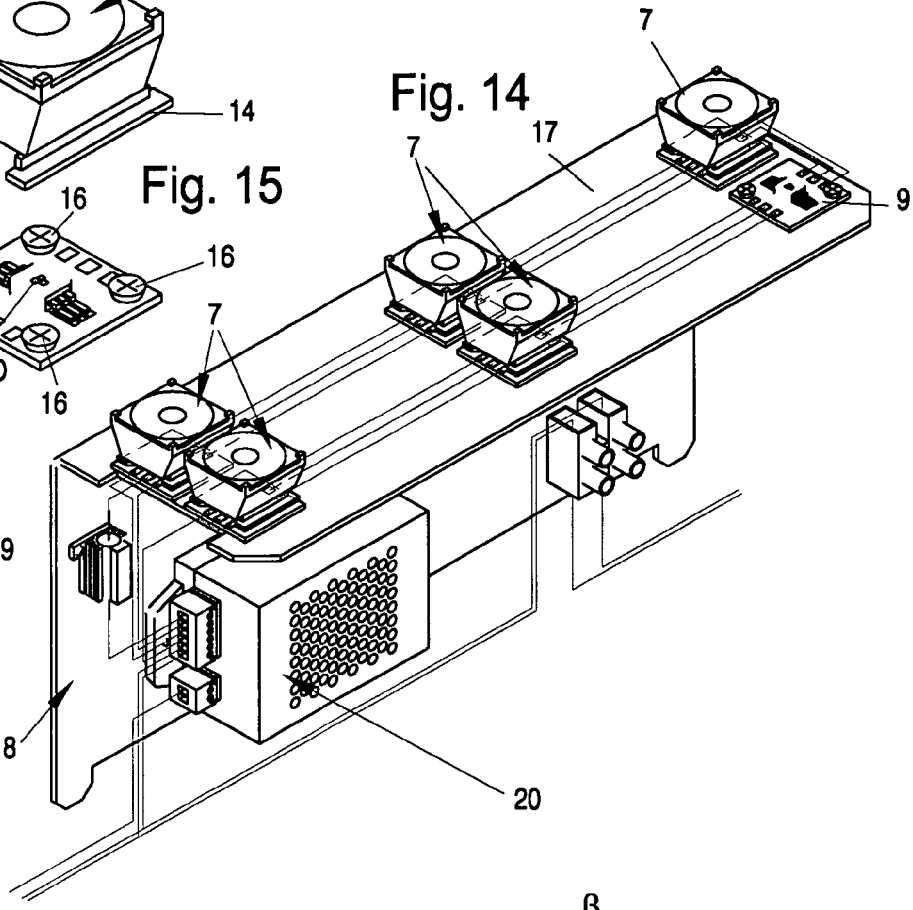
FIG. 14 is an isometric view of an illuminating group.

FIG. 14 shows, moreover, that the plate-like carrier 17 is part of an angle sheet iron 18, to the vertical wall part 19 of which the electrical or electronic components of the control unit 20, which are needed for supplying the LED light source with electricity, are fastened.

In the exemplary embodiment being shown, these wall sockets 21 lie on a horizontal H rail 23 made of steel, which is provided with insulating material 24 on the outside and is in turn mounted on a concrete floor 25 or the like.

The cavities present between the individual support blocks 22, in which the illuminating units are accommodated, are closed by respective boarded walls 26 and 27 on the outside and on the inside. The illuminating units arranged above the light chamber 6 are located in a continuous cavity 28, which is surrounded by a rectangular housing 29.

Figures 4, 5, 6, 7, 8, 9, 10, 11:
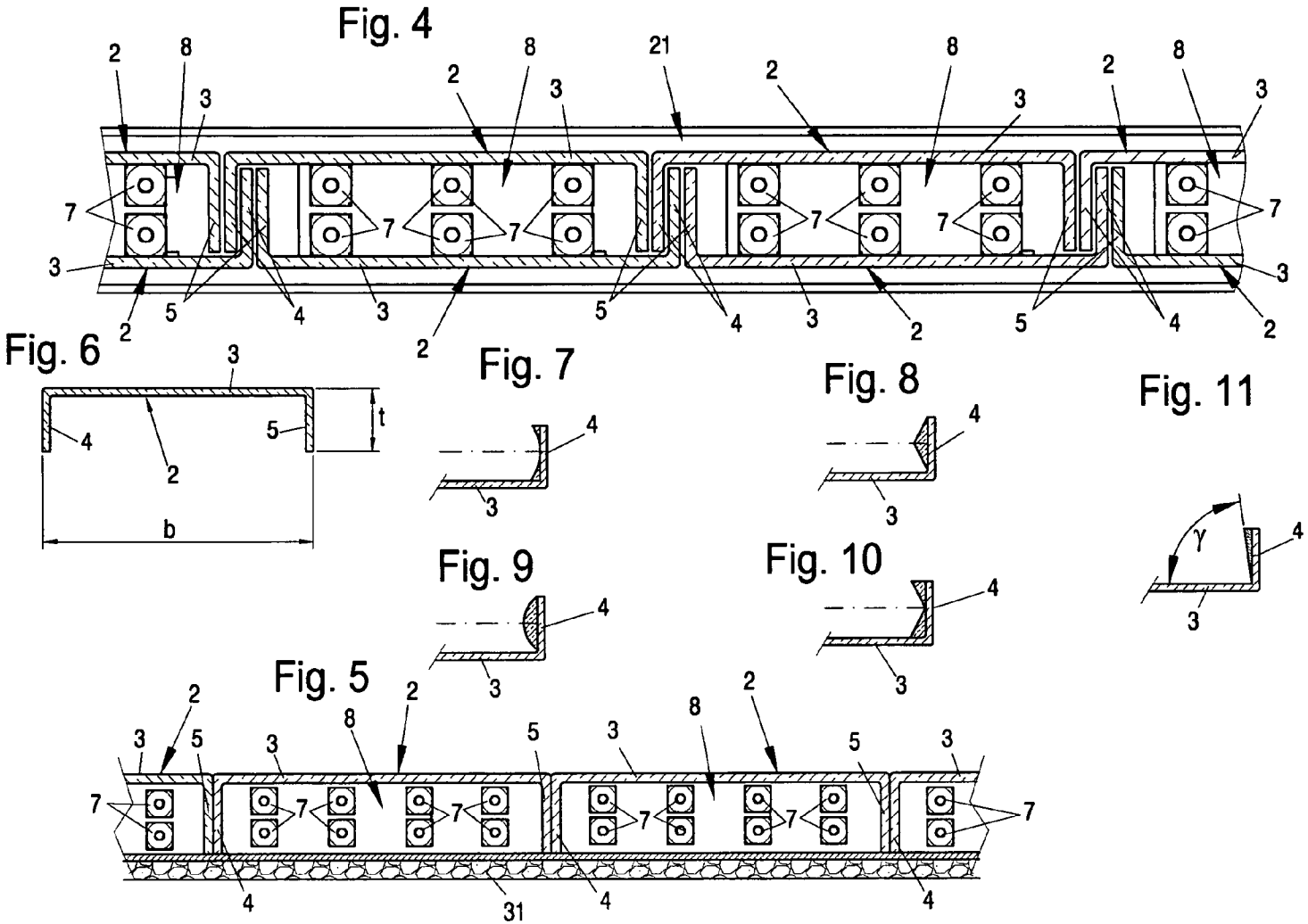
FIG. 4 is an enlarged sectional view along line IV-IV from FIG. 2.
FIG. 5 is a horizontal sectional view of a simpler glass wall from which light exits on one side only.
FIG. 6 is a sectional view of a sectional glass rail with flat inner surfaces of their edge strips.
FIG. 7 is a sectional view showing a design of an inner surface of an edge strip.
FIG. 8 is a sectional view showing another design of an inner surface of an edge strip.
FIG. 9 is a sectional view showing another design of an inner surface of an edge strip.
FIG. 10 is a sectional view showing another design of an inner surface of an edge strip.
FIG. 11 is a sectional view showing another design of an inner surface of an edge strip.

FIG. 5 shows an exemplary embodiment of a glass wall, which likewise comprises a plurality of vertical sectional glass rails 2, in which, however, only one side, namely, that of the wall elements 3, is translucent or transparent. These wall elements 3 of the individual sectional glass rails 2 forming the glass wall opposite sides of the light chambers 6 are closed nontransparently by a nontransparent wall construction 31, which may be of any design.

Illuminating units 8, which contain eight LED light sources 7, which are arranged in four columns each in rows of two and otherwise have the same design as the LED light sources 7 described on the basis of FIGS. 14 through 17, are arranged in the light chambers 6.

Figure 13:
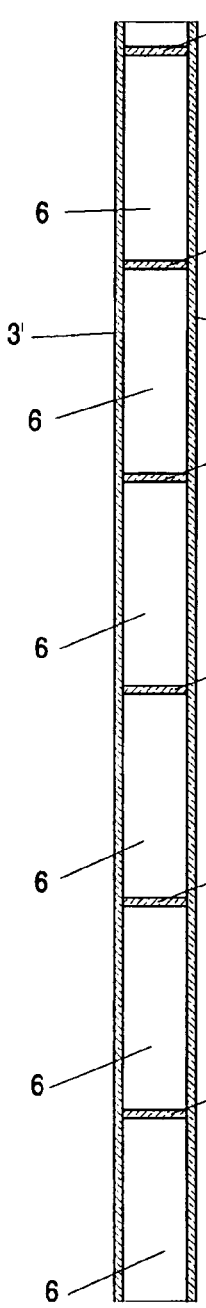
FIG. 13 is a sectional view along section line XIII-XIII from FIG. 12.
Figure 12:
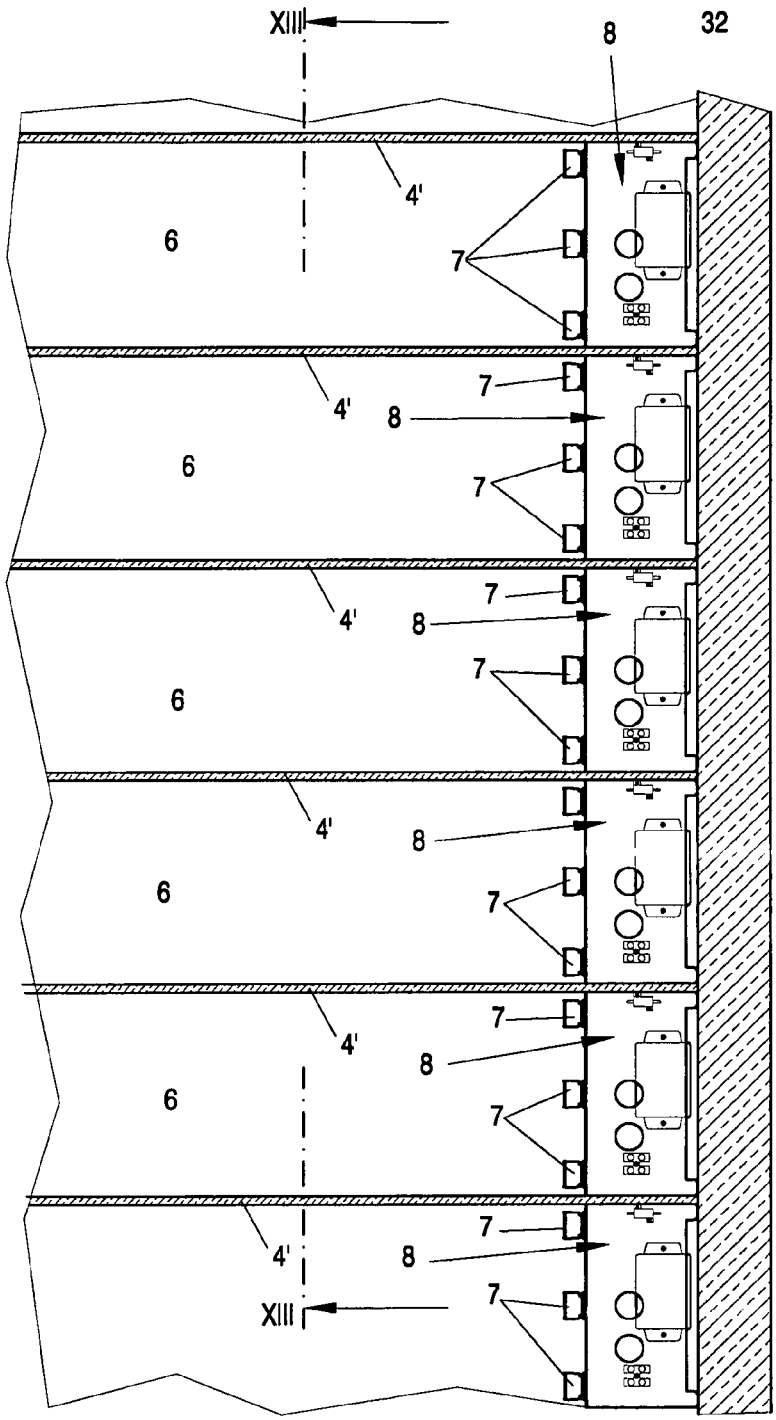
FIG. 12 is a sectional view of a glass wall with horizontal light chambers arranged one on top of another.
Figure 16:
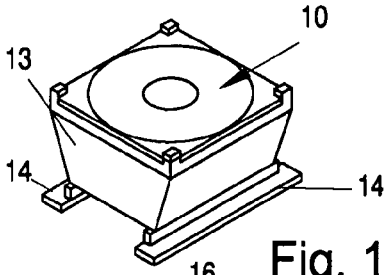
FIG. 16 is an isometric view of a focusing lens.
Figure 15:
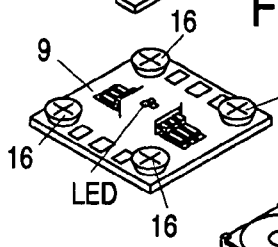
FIG. 15 is an isometric view of a LED carrier plate.

FIGS. 12 and 13 show the design of a glass wall, in which a plurality of horizontal light chambers 6 are arranged one on top of another between two vertical building walls 32. The vertical wall elements 3' consist of flat glass walls, which shall, however, have the same surface structure as the wall elements 3 of the sectional glass rail 2. The horizontal partitions 4', which define and vertically separate from each other the individual light chambers 6, may be designed analogously to the edge strips 4 and 5, respectively, of the sectional glass rails 2, i.e., they may be metal-coated, have a concave or convex shape, arranged extending obliquely or provided with prismatic sections.

The illuminating units 8 are arranged in the embodiment of a glass wall that can be illuminated along the building wall 32 along the inner side of the building wall at the ends of the individual light chambers 6 one on top of another, as this is recognizably shown in FIG. 12.

As in the glass walls with vertical light chambers 6, it depends on the height or the horizontal position of the glass walls whether illuminating units 8 are arranged at the two ends of the light chambers 6. It may be sufficient to arrange an illuminating unit at one end of a light chamber only in case of relatively short or low light chambers.

The number of LED light sources used in such a light chamber to illuminate the light chamber depends on the particular cross-sectional size of a light chamber and on the nature of the translucent glass walls.

Rolled sectional glass rails 2 whose wall elements 3 have a transmission factor of 0.78 to 0.81, a degree of light reflection of 0.13 to 0.16, a direct radiation transmission factor e of 0.68 to 0.71 and a degree of direct radiation reflection E of 0.12 to 0.14, are suitable for such illuminated glass walls 1.

It is always advantageous for a good distribution of light on the surface of a wall element 3 if the inner surfaces irradiated by the light sources 7 are structured in terms of their roughness such that total reflection of the light of the LED light sources 7 is avoided and refraction takes place to such an extent that the largest possible amount of light is sent to the outside through the wall elements 3.

It may be advantageous if the inner and outer surfaces of the wall elements 3 have different degrees of roughness and/or different roughness structures.

While specific embodiments of the invention have been shown and described in detail to illustrate the application of the principles of the invention, it will be understood that the invention may be embodied otherwise without departing from such principles.

What is claimed is:

1. A glass wall comprising:

two opposite wall elements including a first wall element formed of a transparent material with an inner surface having a refractive and reflecting structure and a second wall element positioned parallel to said first wall element;

transverse walls, said first wall element, said second wall element and said transverse walls cooperating to form adjacent elongated light chambers;

a plate-like carriers in an area of a front-side end of said elongated light chambers;

LED light sources arranged in a small number of illuminating groups on said plate-like carriers, said LED light sources being equipped with focusing lenses converging optically to divergence angles of up to 20° and are arranged to provide emitted light in a longitudinal direction of said respective light chamber that is partly reflected multiply on the inner surfaces having a refractive and reflecting structure of said wall elements and partly visible from the outside through the at least one said transparent wall element over a length of said wall element.

2. A glass wall in accordance with claim 1, wherein said light chambers have an essentially rectangular cross-sectional shape.

3. A glass wall in accordance with claim 1, wherein each of said two opposite wall elements of said light chambers are transparent to light.

4. A glass wall in accordance with claim 1, wherein said refractive and reflecting structure of said transparent wall elements are flat.

5. A glass wall in accordance with claim 1, wherein the inner surfaces of said transparent wall elements are arched concavely or convexly.

6. A glass wall in accordance with claim 1, wherein at least one side of said transparent wall elements has a rough surface structure.

7. A glass wall in accordance with claim 6, wherein the inner and outer surfaces of said transparent wall elements have different degrees of roughness.

8. A glass wall in accordance with claim 1, wherein a plurality of said LED light sources are arranged in one plane at one and/or the other end of a light chamber distributed over the cross section of said light chamber.

9. A glass wall in accordance with claim 1, wherein each of said LED light sources is provided with a converging focusing lens, by which a cone angle of an exiting light cone is reduced to a cone angle of up to 20°, which is symmetrical to an optical axis of said LED light source.

10. A glass wall in accordance with claim 9, wherein said focusing lens is provided with a paraboloidal mirror.

11. A glass wall in accordance with claim 1, wherein each said LED light source is provided with a plurality of integrated LEDs, which generate different colors of light, the light being directed at least one of said focusing lenses.

12. A glass wall in accordance with claim 11, wherein the individual LEDs of said individual LED light sources can be actuated separately to generate different colors of light.

13. A glass wall in accordance with claim 1, further comprising:

mounting plates; and a electronic control unit wherein each of said LED light sources is arranged on one of said mounting plates and is connected to an electronic control unit.

14. A glass wall in accordance with claim 1, wherein said light chambers are formed from sectional glass rails including edge strips and said wall elements, said edge strips extending at right angles to said wall elements respectively at long-side edges of each of said wall elements.

15. A glass wall in accordance with claim 14, wherein said sectional glass rails are positioned in an overlapping position against each other with said edge strips cooperating to form said light chambers.

16. A glass wall in accordance with claim 15, wherein said wall elements of a sectional glass rail has a width that is at least twice a depth of connected said edge strip.

17. A glass wall in accordance with claim 15, wherein at least one of said edge strips forming an inner side of said light chamber is metal-coated.

18. A glass wall in accordance with claim 14, wherein an inner side of at least one said edge strip is arched concavely or convexly.

19. A glass wall in accordance with claim 14, wherein the inner side of at least one of said edge strips defining said light chamber has a prismatic shape.

20. A glass wall in accordance with claim 14, wherein the inner surface of one of said edge strips defining said light chamber extends at an acute angle or obtuse angle obliquely in relation to said wall element.

21. A glass wall in accordance with claim 1, wherein in case of vertical arrangement of said light chambers, said carrying support blocks, said horizontal distances between the centers of which correspond to said widths of said sectional glass rails and between which said illuminating groups with the corresponding control units are accommodated, are arranged in a wall socket.

* * * * *